US009957669B2

(12) United States Patent
Ruíz Escalante et al.

(10) Patent No.: US 9,957,669 B2
(45) Date of Patent: May 1, 2018

(54) FISH PLATE CLAMP FOR UNLOADING RAILS

(71) Applicant: FERROVIAL AGROMAN, S.A., Madrid (ES)

(72) Inventors: Jaime Ruíz Escalante, Madrid (ES); Sebastián Marín Castillo, Madrid (ES); Carlos Bartolomé Asensio, Madrid (ES)

(73) Assignee: Ferrovial Agroman, S.A., Madrid (ES)

( * ) Notice: Subject to any disclaimer, the term of this patent is extended or adjusted under 35 U.S.C. 154(b) by 0 days. days.

(21) Appl. No.: 15/303,492

(22) PCT Filed: Apr. 13, 2015

(86) PCT No.: PCT/ES2015/070292
§ 371 (c)(1),
(2) Date: Oct. 11, 2016

(87) PCT Pub. No.: WO2015/155403
PCT Pub. Date: Oct. 15, 2015

(65) Prior Publication Data

US 2017/0037580 A1 Feb. 9, 2017

(30) Foreign Application Priority Data

Apr. 11, 2014 (ES) ..... 201430546

(51) Int. Cl.
*E01B 29/16* (2006.01)
*E01B 29/46* (2006.01)
(Continued)

(52) U.S. Cl.
CPC ..... *E01B 29/46* (2013.01); *B66C 1/64* (2013.01); *E01B 11/02* (2013.01); *E01B 11/56* (2013.01);
(Continued)

(58) Field of Classification Search
CPC ..... E01B 11/02; E01B 11/36; E01B 11/38; E01B 11/56; E01B 29/02; E01B 29/04;
(Continued)

(56) References Cited

U.S. PATENT DOCUMENTS 2,347,922 A * 5/1944 Lee ..... B66C 1/48 294/102.1
2,387,408 A * 10/1945 Pertuit ..... B66C 1/48 294/102.1
(Continued)

FOREIGN PATENT DOCUMENTS

EP 1057933 A2 12/2000
EP 1960604 A1 8/2008
(Continued)

OTHER PUBLICATIONS

International Search Report with English translation for Application No. PCT/ES2015/070292 dated May 28, 2015 (13 pages).

*Primary Examiner* — Dean J Kramer
(74) *Attorney, Agent, or Firm* — Michael Best & Friedrich LLP

(57) ABSTRACT

A fish plate clamp for unloading rails 1. The fish plate clamp includes a support element (11, 12) with a first piece (11) and a second piece (12) each one located on a face of the rail (1). Each piece of the support element (11, 12) includes an internal mortise (13) in the area of the web (3) of the rail (1). The fish plate clamp also includes a gripping element (14) located in an internal mortise (13) of the support element (11, 12). The internal mortises (13) have an inclined surface (15) in a manner that, when the gripping element (14) moves along the length of the inclined surface (15) of the internal mortise (13) in the direction of the pull of the rail (1), the gripping element (14) latches onto the web (3) of the rail (1).

8 Claims, 2 Drawing Sheets

(51) Int. Cl.

| | |
|---|---|
| ***E01B 11/02*** | (2006.01) |
| ***E01B 11/56*** | (2006.01) |
| ***E01B 29/17*** | (2006.01) |
| ***B66C 1/64*** | (2006.01) |
| ***E01B 29/02*** | (2006.01) |

(52) U.S. Cl.
CPC ..... *E01B 29/02* (2013.01); *E01B 29/16* (2013.01); *E01B 29/17* (2013.01)

(58) Field of Classification Search
CPC ..... E01B 29/16; E01B 29/17; E01B 29/46; B66C 1/64
USPC ..... 294/102.1, 119.1; 238/243, 244, 255, 238/260, 261
See application file for complete search history.

(56) References Cited

U.S. PATENT DOCUMENTS

| | | | | |
|---|---|---|---|---|
| 3,552,647 A | | 1/1971 | Plasser et al. | |
| 3,635,164 A | * | 1/1972 | Patton | E01B 29/17 104/2 |
| 5,295,440 A | * | 3/1994 | Cleveland | E01B 29/16 104/2 |
| 5,297,482 A | * | 3/1994 | Cleveland | E01B 29/16 104/2 |
| 2008/0232917 A1 | * | 9/2008 | Hertelendi | E01B 29/17 410/2 |

FOREIGN PATENT DOCUMENTS

| | | |
|---|---|---|
| EP | 2503058 A1 | 9/2012 |
| FR | 2720084 A1 | 11/1995 |

* cited by examiner

FISH PLATE CLAMP FOR UNLOADING RAILS

FIELD OF THE INVENTION

The invention refers to a fish plate clamp used for unloading rails during the assembly of a railway track.

PRIOR ART OF THE INVENTION

During the process of unloading rails to assemble a railway track, the rails are transported on a train called a track-laying train, or on a track parallel to the track being laid, or also, a portion on the assembled track that is available and a pulling machine that pulls the rails so that they slide off the track-laying train onto the railway. The rails come in sections that can be, for example, 270 meters, which are later spliced to shape the railway.

The pulling machine is joined to the first section of the rail with a fish plate clamp and with the pulling of the machine to unload the rail onto the ballast bed. In like manner, the rest of the rail sections are joined to the previous rail section with said fish plate clamp and are then consecutively lowered.

The so called Austria fish plate clamp is known in the state of the art, which comprises knurled surfaces that grip both sides of the rail web. However, this clamp has the drawback that the rail may loosen itself due to the wear of the knurled surface that can begin to have play and let go of the rails during the unloading operation. Another drawback is that the heads of the rails complicate the unloading operation.

DESCRIPTION OF THE INVENTION

The fish plate clamp of the invention solves the previous drawbacks. For this, the clamp comprises a support element that comprises a first piece and a second piece, with each one of the pieces being designed to be located on a face at the end of the rail, so that they put pressure on the rail and drag it by pulling from its end when the pulling machine moves.

The invention is characterized in that each portion of the support element comprises an internal mortise made to be placed adjacent to the rail, said mortises facing each other and with the purpose of being placed in the area of the rail web.

Besides the clamp, it is characterized in that a first element and a second element grasp the rail, each located in the internal mortises of the support element; the grasping element being configured so that it can move with respect of the support element in the longitudinal direction of the rail. The clamp elements are destined to be in contact with the rail, more specifically to be in contact with the rail web.

Said internal mortises comprise an included surface in the longitudinal direction of the rail that becomes narrower towards the free end of the clamp, that is, towards the end of the clamp destined to house the end portion of the rail. In this way, the the depth of the internal mortise decreases towards the free end thereof. In use, when the clamp element shifts in respect to the inclined surface of the mortise in the drag direction of the rail, the clamp element moves together with the rail, and in respect to the inclined surface, latching itself more to the rail.

The subject clamp of the invention provides, therefore, a stronger grip on the rail, as well as minimizing the possibility that the force of the pull on the raised rail may make the rail escape from the clamp. This is because the configuration of the clamp has the effect that the stronger the pull, the stronger the the clamp latches to the rail, putting more pressure on it. Furthermore, said effect of the latching on the rail enables the clamp to have more load capacity with respect to another type of fish plate clamp.

In like manner, despite causing wear on the clamping element, the configuration of the clamp enables it be movable and the surface of the mortise that houses it to be inclined. This wear would be absorbed by the movement of the clamping element in the longitudinal direction.

According to the above, the subject fish plate clamp of the invention is joined at one of its ends to the track pulling machine and at its free end it grips the first rail that is being unloaded from the track-laying train. The clamp that comprises support elements is also subject of the invention, such that they are joined to a rail section with one of them, and joined to another rail section contiguous to the first with the other.

DESCRIPTION OF THE FIGURES

To compete the description and for the purpose of providing better understanding of the invention, a set of drawings is provided. Said drawings form an integral part of the description and display example embodiments of the invention.

DETAILED DESCRIPTION OF THE INVENTION

Figure 1:
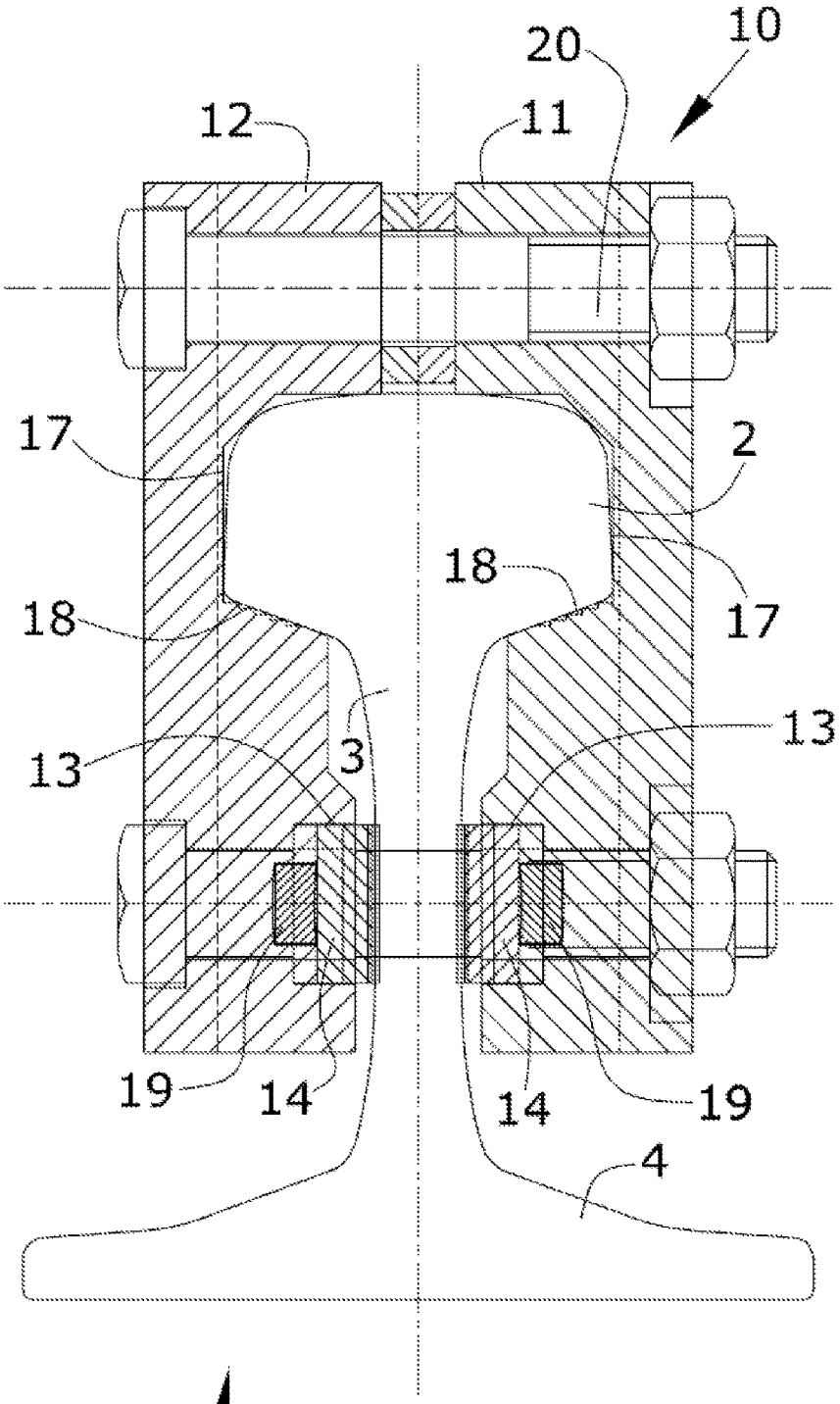
FIG. 1 displays a transversal section of an example embodiment of the subject fish plate clamp of the invention.
Figure 2:
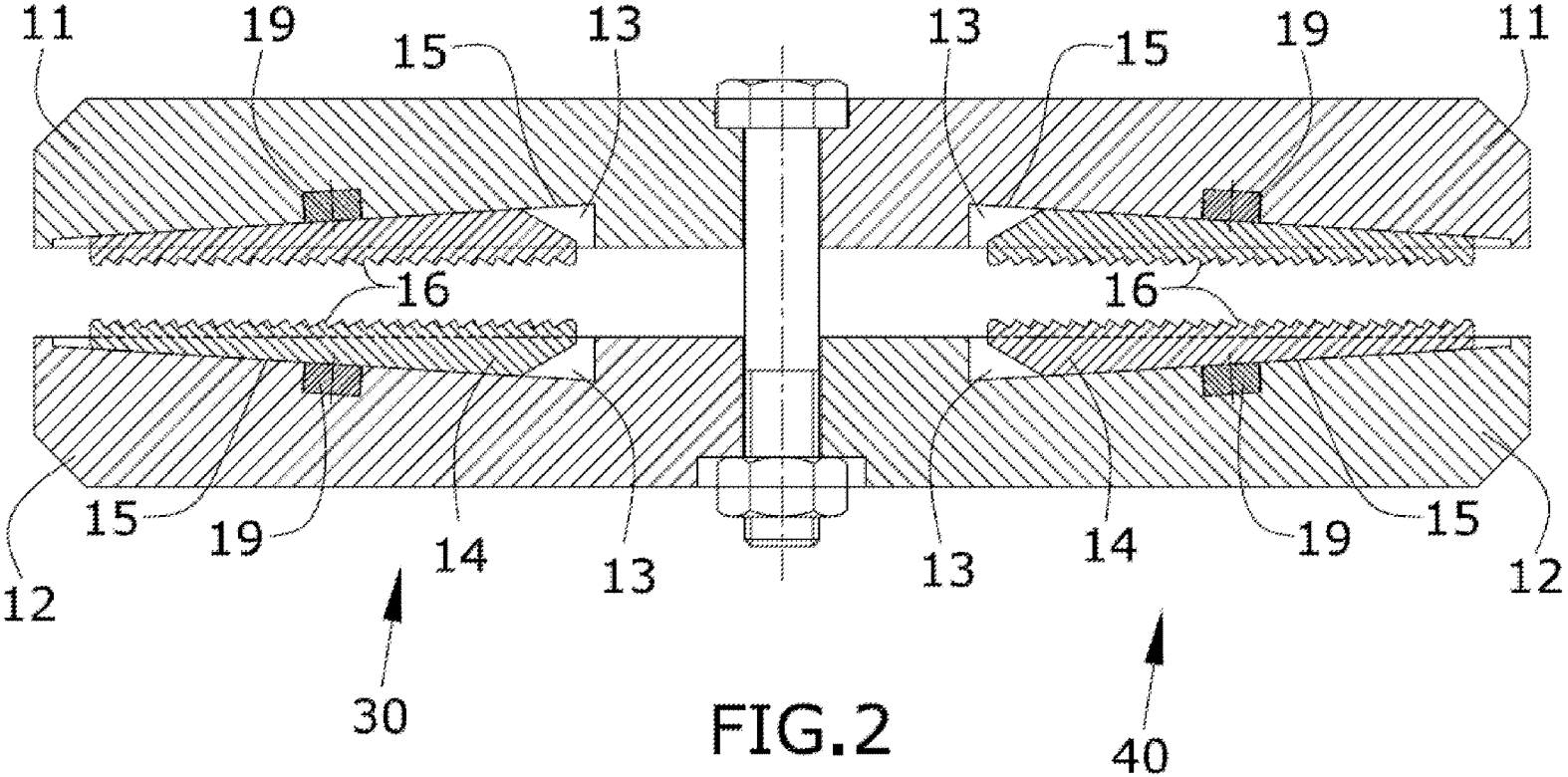
FIG. 2 displays a longitudinal section of a fish plate clamp of the corresponding example embodiment in FIG. 1.

FIGS. 1 and 2 represent an example embodiment of the subject fish plate clamp (10) of the invention. The first piece (11), and second piece (12) of the support element (11, 12) comprise internal facing mortises (13) located in the area of the rail (1) web (3).

The gripping element (14) of the rail (1) located in the internal mortises (13) of the support element (11, 12), is movable with respect of the support element (11, 12) in the longitudinal direction of the rail (1). For this, the internal mortise (13) has a greater longitude than the gripping element (14).

The internal mortise (13) comprises an inclined surface (15) so that the depth of internal mortise (13) decreases towards the free end of the fish plate clamp (10), that is, the internal mortise (13) narrows in the pull direction of the rail (1) so that as the gripping element (14) moves with respect of the inclined surface (15) in the direction of the pull of the rail (1) the gripping element (14) latches onto the web (3) of the rail (1).

With the aim of minimizing the movement between the web (3) of the rail (1) and the gripping element (14), the latter (14) comprises its knurled surface (16) destined to be in contact with the web (3) of the rail (1).

In the displayed example embodiment, the first piece (11) and the second piece (12) of the support element (10) are independent and symmetric pieces, with each one destined to be located on a face of the rail (1) and that are joined together with a screw (20).

The gripping element (14) of the example embodiment is metal. Furthermore, the fish plate clamp (10) comprises magnetic elements (19) joined to the first piece (11) and to the second piece (12) of the support element (10) for the subjection of the fish plate elements (14), so that it attracts said elements (14) against the support element (10), while at the same time allowing the movement of the gripping element (14) with respect of the support element (10).

More specifically, the magnetic elements (19) are located in an orifice on the inclined surface (15) of the internal mortise (13).

Besides the foregoing, and for the purpose of providing stronger subjection of the rail (1), as well as a larger contact surface and also avoiding that the pitching of the rail (1), the first piece (11) and second (12) piece of the support element (11, 12) comprises a recess (17) for lodging the head (2) of the rail (1) that, in the example embodiment shown in the figures, comprises a knurled portion of its adapted surface to be in contact with the rail (1). More specifically, the surface (18) adapted to be in contact with the base of the head (2) of the rail (1) is the knurled surface.

The embodiment displayed in FIG. 2 refers to the case in which the fish plate clamp (10) comprises two support elements (30, 40) that lodge gripping elements (14). In this way, the fish plate clamp (10) is adapted for joining two consecutive rail (1) sections. More specifically, the support elements (30, 40) are located in a symmetrical arrangement with respect to a transversal axis, so that one of the support elements (30) would be adapted for clamping a first rail (1), and the other support element (40) would be adapted for clamping a second rail (1) located in line with the first (1).

In like manner a fish plate clamp (10) like the one disclosed in FIG. 2, would also be adapted for joining the pulling machine to the first rail (1) section, as long as the pulling machine comprises a small rail (1) section to be joined to the fish plate clamp (10). Optionally, the joining to the pulling machine could be done with a bolt, such that the fish plate clamp (10) would have a single support element (11, 12).

The invention claimed is:

1. A fish plate clamp (10) for unloading rails (1), the fish plate clamp (10) comprising:

support elements (30, 40) including a first piece (11) and a second piece (12) adapted so that each piece (11, 12) is located on a face of a rail (1) at an end of the rail (1), characterized in that:

each of the first piece and the second piece includes an internal mortise (13) on a face of the piece destined to be placed adjacent to the rail (1), each of the internal mortises (13) being adapted to be placed facing the area of the web (3) of the rail (1); and first and second gripping elements (14) located in respective internal mortises (13) in such a way that the gripping element (14) is movable with respect to the respective support element (30, 40) in the longitudinal direction of the rail (1), wherein each of the internal mortises (13) includes an inclined surface (15) in a manner that the internal mortise (13) longitudinally decreases in depth towards the end of the fish plate clamp (10) destined to lodge the end of the rail (1), the gripping elements (14) and the internal mortises (13) being configured in a manner that, when the gripping element (14) moves along the length of the inclined surface (15) of the internal mortise (13) in the direction in the pulling of the rail (1), the gripping element (14) latches onto the web (13) of the rail (1), and wherein the support elements (30, 40) are in a symmetrical arrangement with respect to a transversal axis, so that one of the support elements (30) is adapted for clamping a first rail (1), and the other support element (40) is adapted for clamping a second rail (1) located in line with the first rail (1).

2. The fish plate clamp (10) for unloading rails, according to claim 1, characterized in that the gripping element (14) comprises a knurled surface (16) destined to be in contact with the web (3) of the rail (1).

3. The fish plate clamp (10) for unloading rails, according to claim 1, characterized in that the first piece (11) and the second piece (12) of the support element (10) are independent and symmetrical pieces, each one destined to be located on a face of the end of the rail (1).

4. The fish plate clamp (10) for unloading rails, according to claim 1, characterized in that the gripping element (14) is metal.

5. The fish plate clamp (10) for unloading rails, according to claim 4, characterized in that the fish plate clamp (10) comprises magnetic elements (19) joined at the first piece (11) and the second piece (12) to attach the gripping elements (14) to the first and second pieces (11, 12).

6. The fish plate clamp (10) for unloading rails, according to claim 1, characterized in that the first piece (11) and the second (12) piece of the support element (10) comprise on their face destined to be located adjacent to the rail (1) a recess (17) for lodging the head (2) of said rail (1).

7. The fish plate clamp (10) for unloading rails, according to claim 6, characterized in that the recess (17) for lodging the head (2) of the rail (1) comprises a knurled portion on a surface (18) of the recess adapted for being in contact with the rail (1).

8. The fish plate clamp (10) for unloading rails, according to claim 7, characterized in that the surface (18) adapted to be in contact with the base of the head (2) of the rail (1) is the knurled surface.

* * * * *